US007798076B1

(12) United States Patent
Neff

(10) Patent No.: US 7,798,076 B1
(45) Date of Patent: Sep. 21, 2010

(54) MODULAR FURNITURE SYSTEM

(75) Inventor: Hannes K. Neff, Warwick, RI (US)

(73) Assignee: Round and Round LLC, Carrollton, TX (US)

( * ) Notice: Subject to any disclaimer, the term of this patent is extended or adjusted under 35 U.S.C. 154(b) by 0 days.

(21) Appl. No.: 11/126,750

(22) Filed: May 11, 2005

(51) Int. Cl.
*A47B 91/00* (2006.01)

(52) U.S. Cl. ..... 108/186; 108/157.13

(58) Field of Classification Search ..... 108/180, 108/182, 10, 153.1, 158.11, 158; 312/107, 312/108, 111; 211/189, 194, 195; 248/220.21, 248/224.8, 222.14
See application file for complete search history.

(56) References Cited

U.S. PATENT DOCUMENTS 1,220,447 A 3/1917 Onken
1,431,823 A 10/1922 Leconte
2,366,677 A * 1/1945 Rosenthal ..... 108/60
3,783,801 A * 1/1974 Engman ..... 108/60
3,831,533 A * 8/1974 Kellogg ..... 108/64
4,275,666 A 6/1981 Schriever
4,662,591 A * 5/1987 Encontre ..... 248/188
4,706,573 A 11/1987 Sielaff
D294,828 S * 3/1988 Jones et al. ..... D14/252
5,363,775 A 11/1994 Simpson
5,365,775 A * 11/1994 Penniman ..... 73/53.04
5,400,719 A * 3/1995 Santapa et al. ..... 108/64
5,595,312 A * 1/1997 Dardashti ..... 211/188
5,941,183 A * 8/1999 Ming-Shun ..... 108/153.1
6,676,231 B1 * 1/2004 Kelley et al. ..... 312/107
2003/0075083 A1 4/2003 Devey
2003/0210954 A1 * 11/2003 Kang ..... 404/6

* cited by examiner

*Primary Examiner*—José V Chen
*Assistant Examiner*—Matthew W Ing
(74) *Attorney, Agent, or Firm*—Salter & Michaelson

(57) ABSTRACT

A modular furniture system that includes a base cabinet having a drawer used for storage and able to be opened and closed; a plurality of shelf members; means for support the plurality of shelf members in at least one stacked array over said base cabinet; and a plurality of modular leg members that are interengageable by screwing together and that are adapted for placement in said drawer.

14 Claims, 13 Drawing Sheets

MODULAR FURNITURE SYSTEM

TECHNICAL FIELD

The present invention relates in general to furniture. More particularly, the present invention pertains to a modular furniture system that can be readily assembled to construct shelving, tables, chairs, benches, desks, bedding and other furniture items.

BACKGROUND OF THE INVENTION

Traditional furniture has been used to furnish homes, offices and condos for countless years. Traditional furniture is made in a number of different styles, using a variety of materials and finished with a variety of surface finishes. One common feature of traditional furniture, however, is that it comes completely assembled from the furniture manufacturer, and once the item of furniture has been made, it can not be otherwise modified or tailored to suit the purchaser or the environment in which it is to be used.

As an alternative to pre-finished manufactured "traditional" furniture, many consumers have purchased unfinished furniture or unfinished furniture kits. In these unfinished furniture kits, all the necessary pieces of furniture are provided to assemble a piece of furniture, whereupon the consumer finishes the furniture itself. However, although unfinished furniture kits have become a popular and usually less expensive alternative to traditional furniture, the problem remains that even these furniture kits are only constructed to form traditional pieces of furniture once assembled, and do not allow for any degree of flexibility in assembly, or the ability to be readily modified into other pieces of furniture for use in a house, condo, office or other environment.

In an effort to provide more flexibility in furniture, some manufacturers have provided shelving units, such a metal shelving units, which can be assembled in a variety of shelving configurations. Others have used, for example, "egg" crates, or "milk" crates. These crates have been typically used in conjunction with standard wooden planks to form fixed shelving units. These "crate" arrangements have very limited configuration flexibility and are not readily adapted for use as more traditional pieces of furniture, such as, chairs, tables, benches, and the like.

What is needed, therefore, but seemingly unavailable in the art is a modular furniture system that can be used for fashioning a large variety of furniture pieces which can be used throughout the house or office to include shelves, tables, chairs, benches, lamps, plant stands. The use of the modular furniture system of the present invention includes, but is not limited to, bedroom furniture such as beds, end tables, benches, night stands, vanities and the like. Another use is as office furniture to include desks, credenzas, and other pieces of furniture. Moreover, what is needed is a modular furniture system which is easy to assemble, inexpensive to purchase, highly flexible, but yet is available in a variety of finishes, textures and/or patterns for use in an extremely wide variety of applications throughout the home, the office, as well as in schools, churches, pre-schools, and any other facility in which furniture is needed.

SUMMARY OF THE INVENTION

The present invention provides an improved modular furniture system which overcomes a number of the design deficiencies of other pieces of furniture known in the prior art, and which represents a significant advance in the art. The improved modular furniture system of the present invention provides a highly flexible furniture system easily adaptable to the needs of the consumer or end-user, which can be used in a variety of home or office applications, as well as in pre-schools, schools, and other commercial facilities, yet which is easy and inexpensive to construct, and may be arranged in a variety of configurations. Accordingly, the improved modular furniture system of this invention can be matched to the needs of the individual user or institutional user, for example a school or other commercial/office facility, by providing a highly flexible and relatively inexpensive modular furniture system useful for creating a variety of furniture pieces commonly found in such facilities.

The improved modular furniture system of this invention uses an elongate post or leg member, that can be constructed of almost any material, and which can be either hollow or solid, used in combination with, inter alia, a plurality of shelving members. Moreover, the improved modular furniture system of this invention uses virtually no external hardware for assembly, yet provides a durable furniture construction.

Accordingly, it is an object of the present invention to provide an improved modular furniture system which is highly flexible as to configuration, so that the furniture can be assembled into a variety of furniture pieces, and a variety of configurations.

It is another object of the present invention to provide an improved modular furniture system which is easy to assemble and which does not require any tools for use in assembling the furniture.

It is yet another object of the present invention to provide an improved modular furniture system which is readily inexpensive when contrasted with the cost of more traditional furniture, as well as unfinished furniture kits.

Still another object of the present invention to provide an improved modular furniture system which is simple in design, easy to construct and assemble and is durable and rugged in structure.

To accomplish the foregoing and other objects of this invention there is provided, in accordance with one aspect of the present invention, a modular furniture system comprising: a base cabinet having a drawer used for storage and able to be opened and closed; a plurality of shelf members; means for support the plurality of shelf members in at least one stacked array over the base cabinet; and a plurality of modular leg members that are interengageable by screwing together and that are adapted for placement in the drawer.

In accordance with other aspects of the present invention the drawer has means at the front thereof that enable a user to open and close the drawer; the plurality of shelf members include a base shelf member and two sets of narrower shelf members disposed over the base shelf member; including a plurality of cap screws that may be threadedly engageable with a corresponding modular leg member; including a threaded ring that is engageable with at least one of a cap screw and modular leg; the shelf members have a hole at least one end thereof and a shelf member is positioned between the leg member and cap screw; each leg member has a male end and a female end; the base cabinet has a top wall with a plurality of holes therein and a plurality of the leg members having a threaded male end extending upwardly through the hole in the top wall, said shelf members also having holes therein that fit over the male end; each leg member has a threaded male end and a threaded female end, the shelf members having a hole at opposite ends thereof and the shelf member is positioned between leg members and engaged with the leg member via the hole; and including a door cabinet supported over said base cabinet and supported by a set of said leg members.

In accordance with still a further aspect of the present invention there is provided a modular furniture system comprising: a plurality of shelf members each having at least one hole at one end thereof; a plurality of modular leg members that are interengageable by screwing together and that each have a threaded male end and a threaded female end; a base piece from which a set of leg members is supported in an upright position; and a set of at least two leg members supporting a shelf member thereover.

In accordance with further aspects of the invention the base piece comprises a base cabinet having a drawer used for storage and able to be opened and closed; the drawer has means at the front thereof that enable a user to open and close the drawer and wherein the plurality of shelf members include a base shelf member and two sets of narrower shelf member including a plurality of cap screws that may be threadedly engageable with a corresponding modular leg member and a threaded ring that is engageable with at least one of a cap screw and modular leg; including a first leg member set supported from said base piece, having the male end extending upwardly for receiving a shelf member at respective ends thereof, each shelf member having opposite holes therein that receive the male end of the leg member; including a cap screw over the shelf member for engaging with the male end of the leg member; and including a support for a mattress supported from the leg members.

In accordance with still another aspect of the present invention there is provided a modular furniture kit comprising: a base cabinet having a drawer used for storage and able to be opened and closed; a plurality of shelf members; a plurality of support members for support the plurality of shelf members in at least one stacked array over the base cabinet; and a plurality of modular leg members that are interengageable by screwing together and that are adapted for placement in the drawer.

In accordance with further aspects of the invention the drawer has means at the front thereof that enable a user to open and close the drawer and the plurality of shelf members include a base shelf member and two sets of narrower shelf members disposed over the base shelf member.

BRIEF DESCRIPTION OF THE DRAWINGS

The foregoing and other objects, advantages and features of the present invention will become apparent upon a reading of the following detailed description when taken in conjunction with the accompanying drawings, wherein.

DETAILED DESCRIPTION

Figure 1:
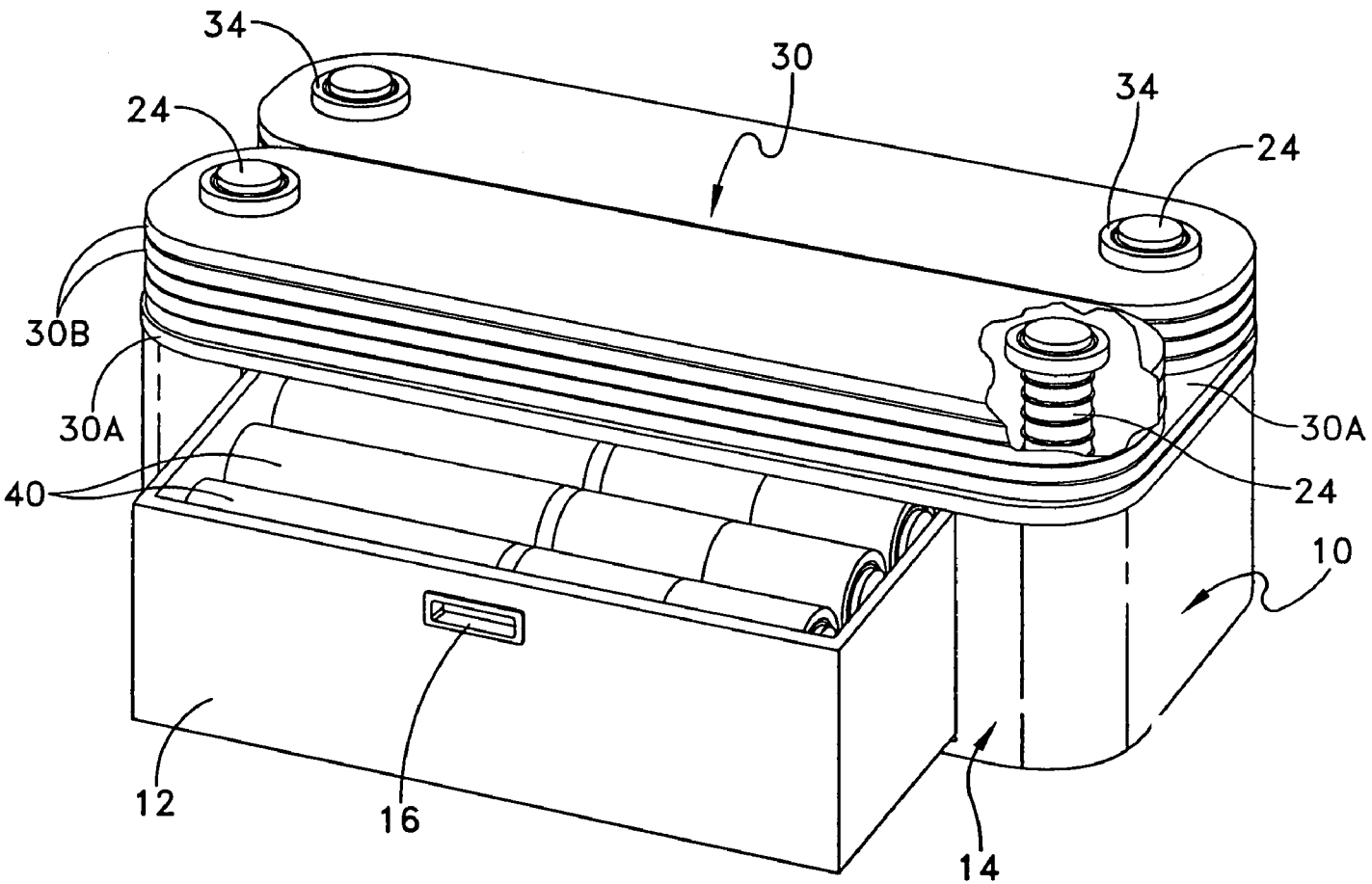
FIG. 1 is a perspective view of the modular furniture system of one embodiment of the present invention as presented in an as-sold form.
Figure 5:
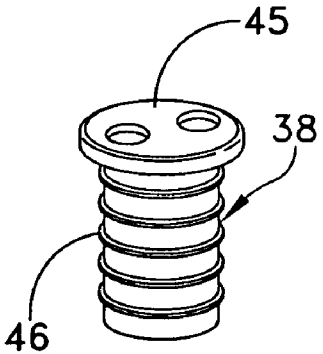
FIG. 5 is a perspective view of a cap screw member use in the modular furniture system of the present invention.
Figure 6:
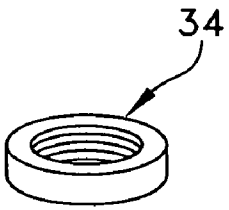
FIG. 6 is a perspective view of a ring member use in the modular furniture system of the present invention.
Figure 7:
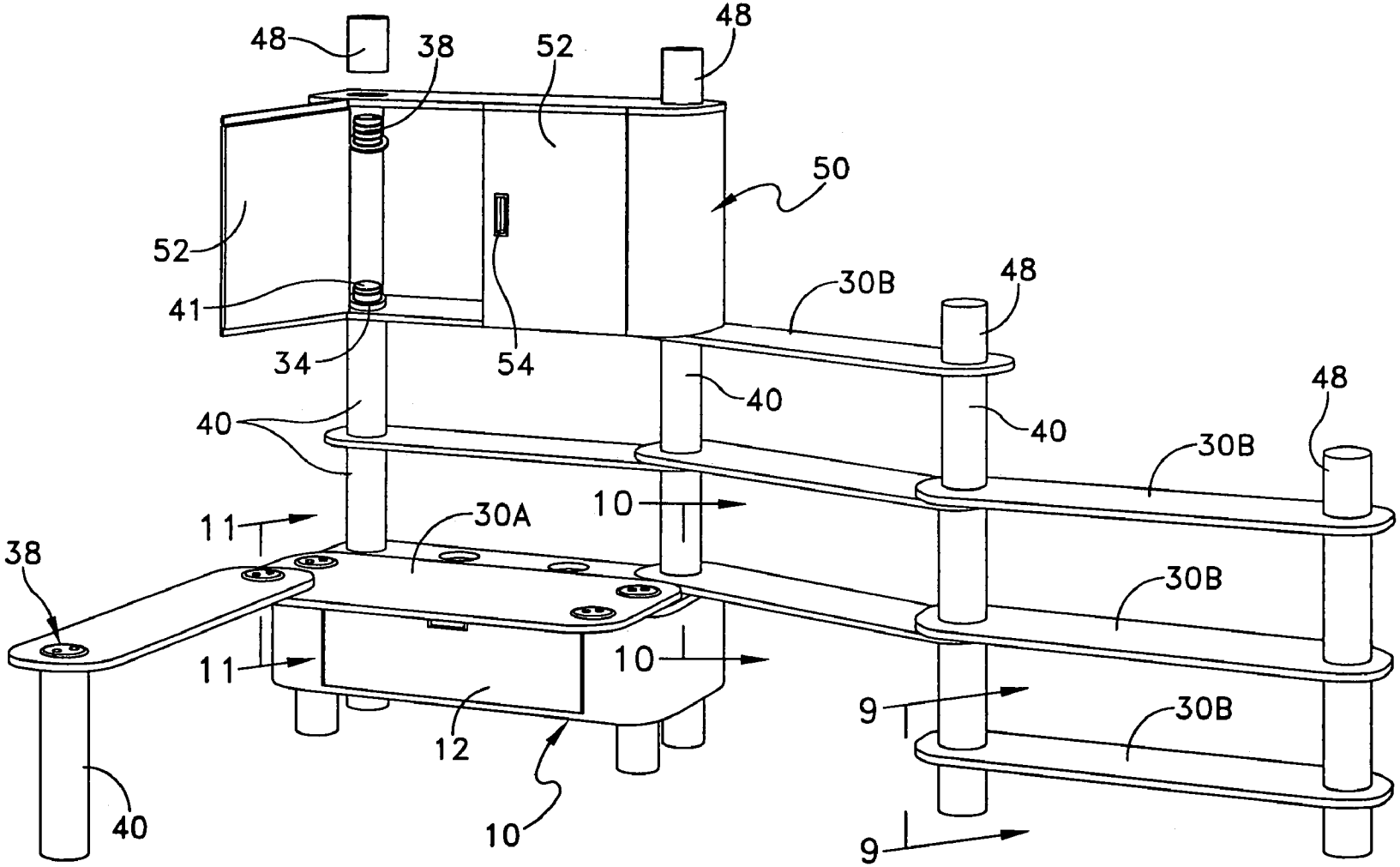
FIG. 7 shows a final configuration of the modular furniture system assembled as a cabinet and shelving.
Figure 8:
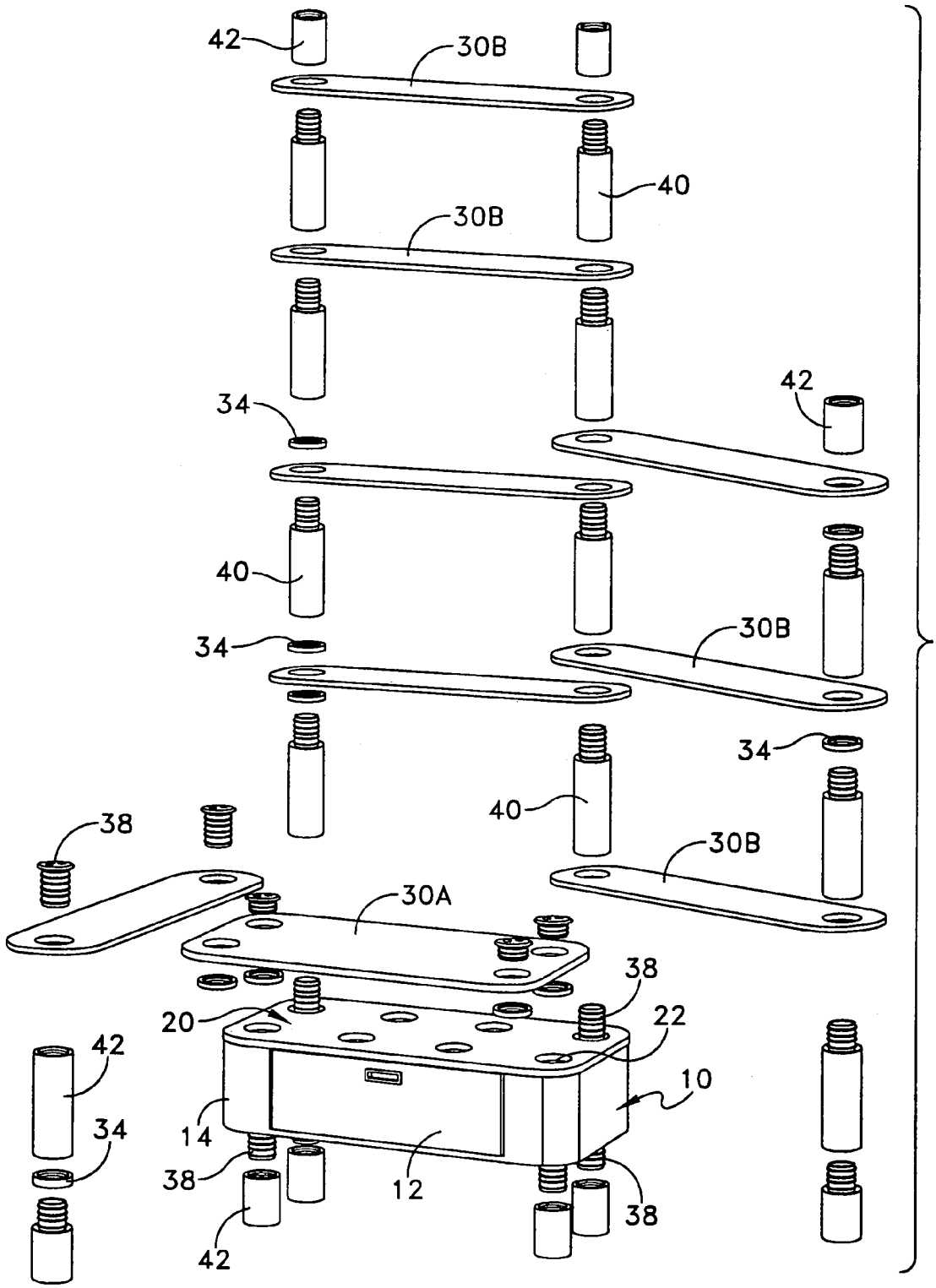
FIG. 8 is a perspective view of the configuration of FIG. 7 in an exploded form.

Referring now to the drawings, in which like reference characters indicate like parts throughout the drawings, FIG. 1 illustrates a preferred embodiment of the modular furniture system or kit of the present invention. This may be considered a basic kit. The modular system may also be constructed in larger kits to construct larger pieces of furniture. In the drawings FIGS. 2-6 illustrate the separate components that are used in the basic kit or system. FIGS. 7 and 8 illustrate one of many different furniture arrangements that may be constructed with the modular furniture system of the present invention.

Figure 2:
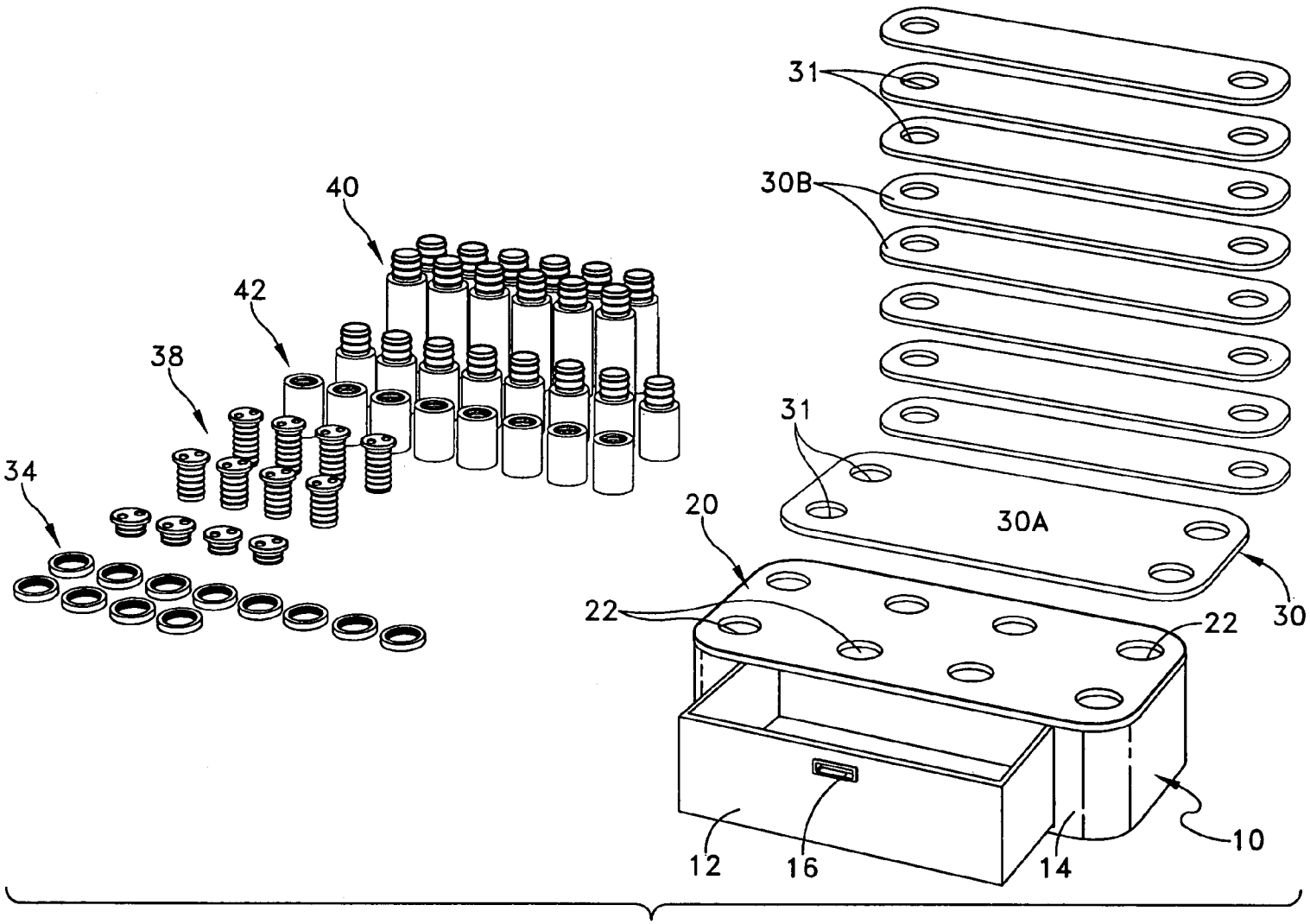
FIG. 2 is a perspective view showing, in an exploded form, all of the various components that make up the modular furniture system of the present invention illustrated in FIG. 1.

Referring now to FIGS. 1-6, the modular furniture system or kit comprises a base cabinet 10 that may be constructed of a plastic material or a lightweight wood material. This cabinet has sides, a back, a bottom, a top and a front. The base cabinet may be constructed with supporting ribs or other appropriate supporting framework. A drawer 12 is supported from the front face 14 of the base cabinet. The drawer 12 may be supported in a known manner within the base cabinet so as to be able to be readily manually moved in and out. FIGS. 1 and 2 show the drawer 12 in an open position while FIG. 7 shows the drawer closed. The front of the drawer 12 is provided with a recessed handle 16 that enables a user to push the drawer in and to pull the drawer out. Appropriate runners (not shown) may be provided so that the drawer can be properly supported and moved in and out.

As further illustrated in FIG. 2, the base cabinet 10 includes a top 20 that is provided with a series of holes 22, at least some of which receive corresponding threaded posts 24. These posts may be in the form of an inverted cap screw such as illustrated at 38 in FIG. 5 herein, arranged extending up through the corresponding hole 22. In FIG. 2 the top 20 of the cabinet 10 is actually provided with eight holes 22 disposed in four sets of two each. The assembled version illustrated in FIG. 1 shows the use of only four threaded posts accommodated in four corresponding holes 22, all extending upwardly from the top 20.

The modular furniture base system also has, disposed over the base cabinet 10, the shelf members 30. The shelf members may be used to form shelf units or for other support purposes.

FIG. 7 illustrates one manner in which shelf members can be assembled in building a furniture system. The shelf members 30 are illustrated as being in two different sixes including a set of two wider shelf members 30A and eight narrower shelf members 30B. Each of these sets may be constructed with greater or fewer numbers of shelf members. Each shelf member has at least one hole 31 at each longitudinal end. For the wider shelf members there are two holes at each end as illustrated in FIG. 2. FIG. 1 illustrates the narrower shelf members 30B as supported over the base cabinet in two sets of four each. However, there may be different numbers of shelf members in each set.

Thus, as illustrated in FIG. 1 with the use of four threaded posts 24, the holes of each shelf member fit over each post. The shelf members are secured in place, such as in the position shown in FIG. 1 with the use of a series of threaded rings 34. Each ring 34 is threaded to a corresponding post 24 to hold the shelf members in place. FIG. 1, it is noted, has a small partial cut-away portion to show the threads of the support post. As indicated previously each of these posts may be formed by a cap screw, such as the cap screw 38 illustrated in FIG. 5 positioned upside down and inserted in through the cabinet 10 up through the hole 22. Once the ring 34 is threaded onto the cap screw it stays in place.

FIG. 1 also shows the drawer 12 containing leg members 40. Most of the leg members are male-female members that can be stored by threading members together in series. FIG. 1 shows three leg members screwed together in a single structure. It is the intent to sell the modular furniture system in a compact format and by threading the leg members together the various pieces can be stored easily and compactly. Easy access is provided to these various pieces by opening the drawer 12. Also, not only are these leg members stored in the drawer 12, but also other modular furniture pieces can be readily stored such as those disclosed in FIGS. 2-6.

Figure 3:
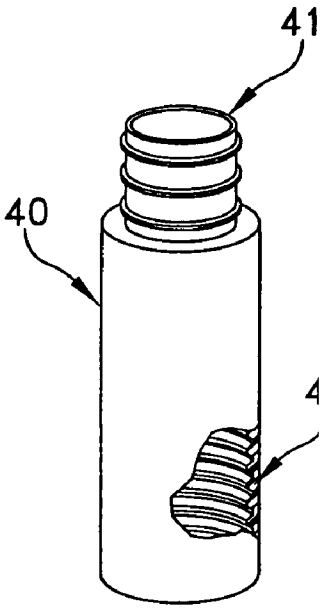
FIG. 3 is a perspective view of a leg member (male-female) use in the modular furniture system of the present invention.

In addition to the leg members 40, rings 34 and cap screws 38, the modular furniture system of the present invention preferably also includes members of different sizes and/or lengths and the female-female leg members 42. FIG. 2 illustrates two different length leg members 40. There are shown twelve leg members that are 12 inches long and eight leg members that are 6 inches long. Of course, the leg members may also be of different lengths and diameters. FIG. 3 is a perspective view of one leg member having a male end 41 and a female end 43, each having threads, as shown.

Figure 4:
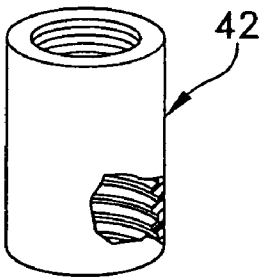
FIG. 4 is a perspective view of a different leg member (female-female) use in the modular furniture system of the present invention.

FIG. 2 also shows eight female-female leg members 42 that may each be 6 inches long. Of course, the leg members 42 may also be of different lengths and diameters. FIG. 4 is a perspective view of one female-female leg member 42 having female ends at each end, each having threads, as shown. There may be separate internal threads at each end or the leg member 42 may be threaded entirely through from one end to the opposite end.

FIG. 2 also shows cap screws 38 that are illustrated as of two different lengths. In FIG. 2 there are eight cap screws that may each be 6 inches long and four shorter cap screws. The cap screws may be of different lengths and diameters. FIG. 5 is a perspective view of one cap screw 38 having a head 45 and a threaded shaft portion 46.

FIG. 2 also shows the threaded rings 34. There are twelve such rings 34 illustrated in FIG. 2. FIG. 6 is a perspective view of a threaded ring member 34. In FIGS. 2-6 these members or pieces may be constructed of a plastic material. They are preferably light in weight and manufactured in various colors or patterns.

The kit depicted in FIG. 1 is meant to be sold with all pieces that make up the furniture arrangement either stored over the base cabinet 10 or stored in the cabinet drawer 12. As indicated previously several of the components are adapted for storage in the drawer 12 either singly or preferably screwed together to make the storage more compact. In addition, as illustrated in FIG. 1, the shelf pieces are disposed over the base cabinet 10 with the use of posts 24 (inverted cap screws) and threaded rings 34. To construct a piece of furniture one simply unthreads the rings 34 enabling them to detach from the post. The post can then be removed from inside the cabinet and all of the shelf members are then accessible to the user The user can then assemble the various pieces in an arrangement such as depicted in, for example, FIG. 7.

Refer now to FIG. 7 for an illustration of one of many different furniture arrangements that can be formed with the modular furniture system of the present invention. This furniture arrangement is made up of a basic kit along with additional pieces such as the overhead cabinet 50. Cabinet 50 includes front doors 52 each with a handle 54. In FIG. 7 one of the doors is shown opened and the other door is in its closed position. The cabinet 50 is supported by a series of upright leg members 40 that are screwed together in the positions shown with shelving therebetween. The cabinet 50 has holes in top and bottom surfaces for receiving ends of leg members or cap screws. For example, in FIG. 7 at the open door 52 there is disclosed a screw top 41 of one leg member extending through a hole in the bottom surface of the cabinet 50 and secured by means of a threaded ring 34. At the location above that a further female cap member 48 may be used, in combination with, a male cap screw 38 to provide a decorative top post on the cabinet 50. Member 48 unlike member 42 may have only one internally threaded female end and is closed at the opposite end so as to provide an external finish piece.

Figure 9:
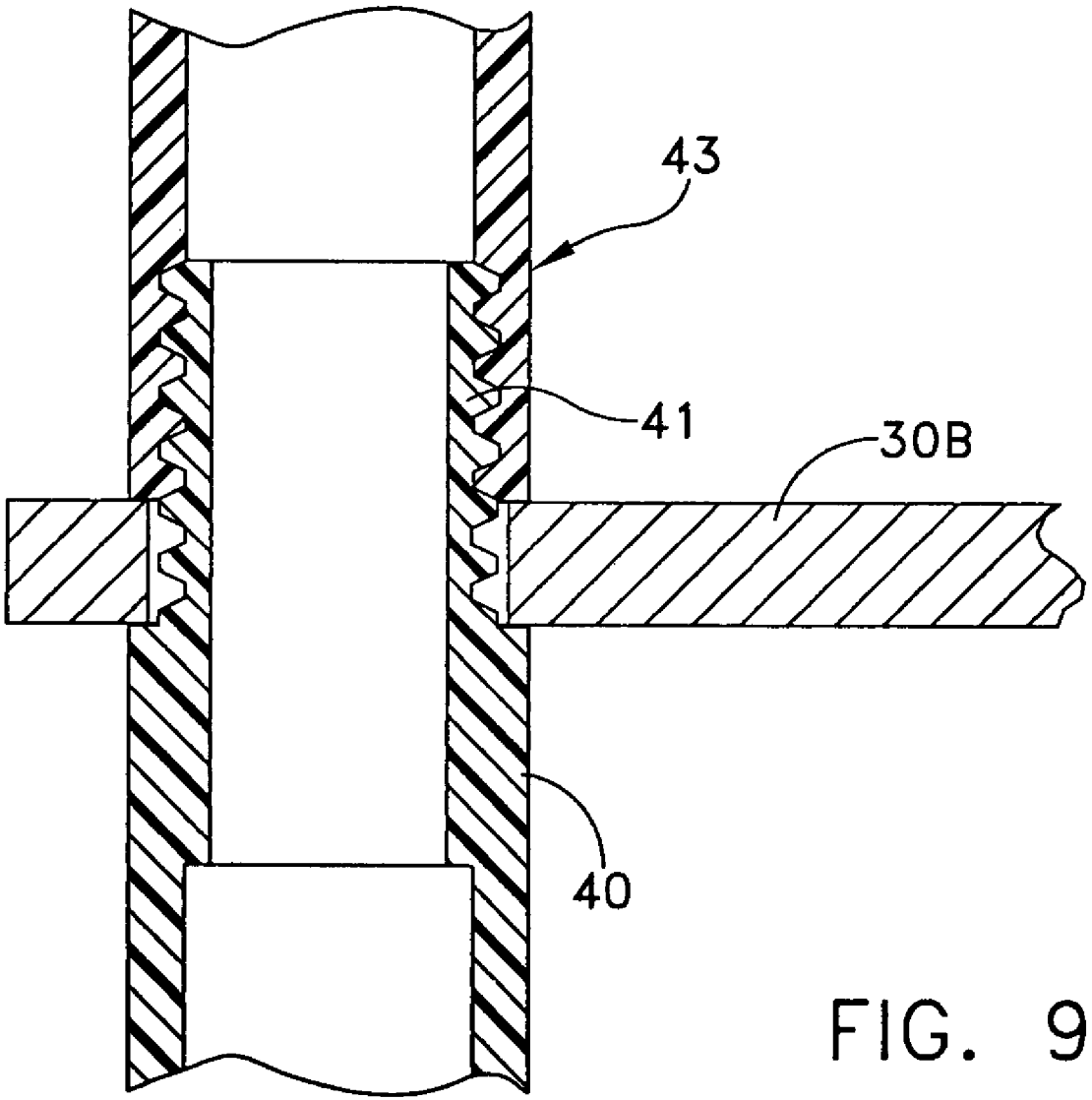
FIG. 9 is a cross-sectional view as taken along line 9-9 of FIG. 7 illustrating the manner in which the leg members are interconnected.
Figure 10:
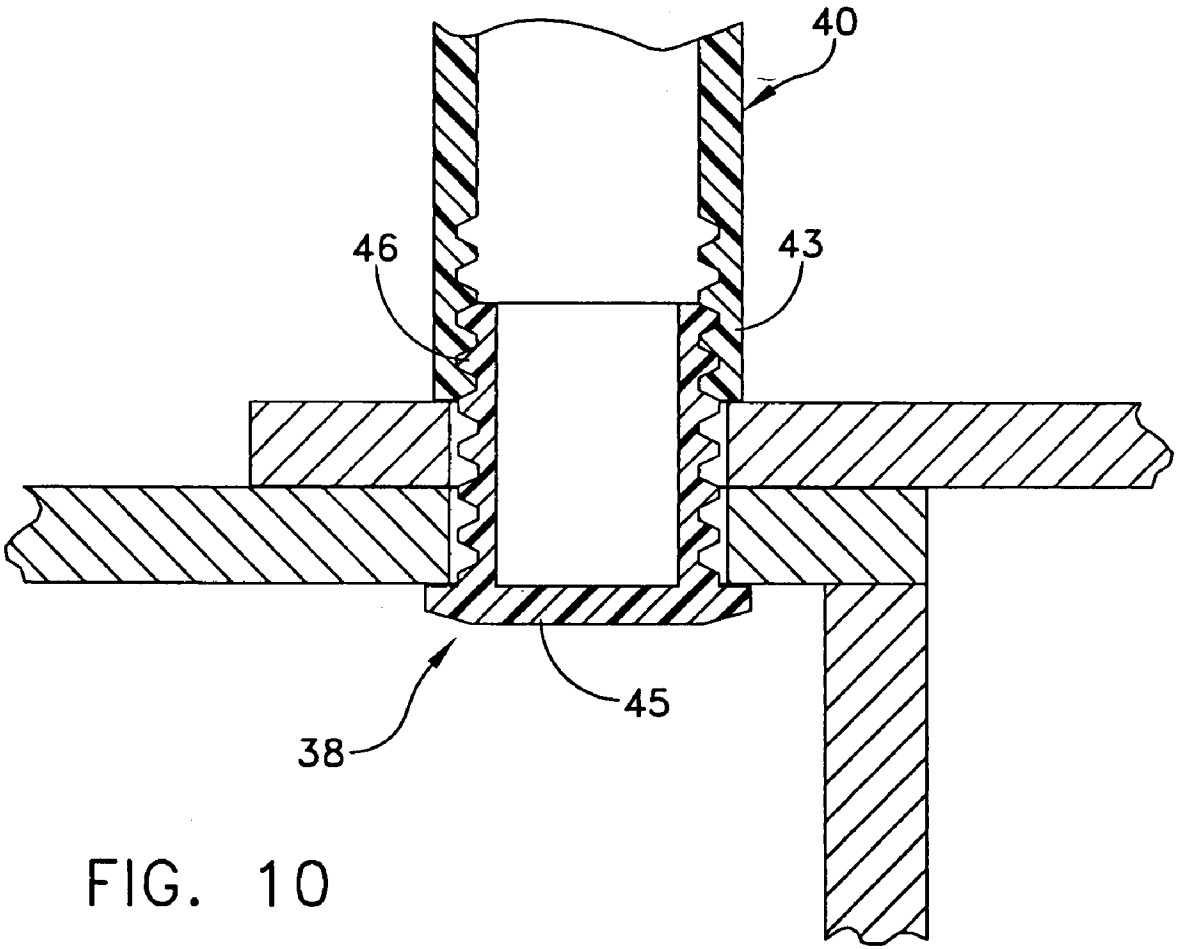
FIG. 10 is a cross-sectional view as taken along line 10-10 of FIG. 7 illustrating the manner in which a leg members and cap screw are interconnected.
Figure 11:
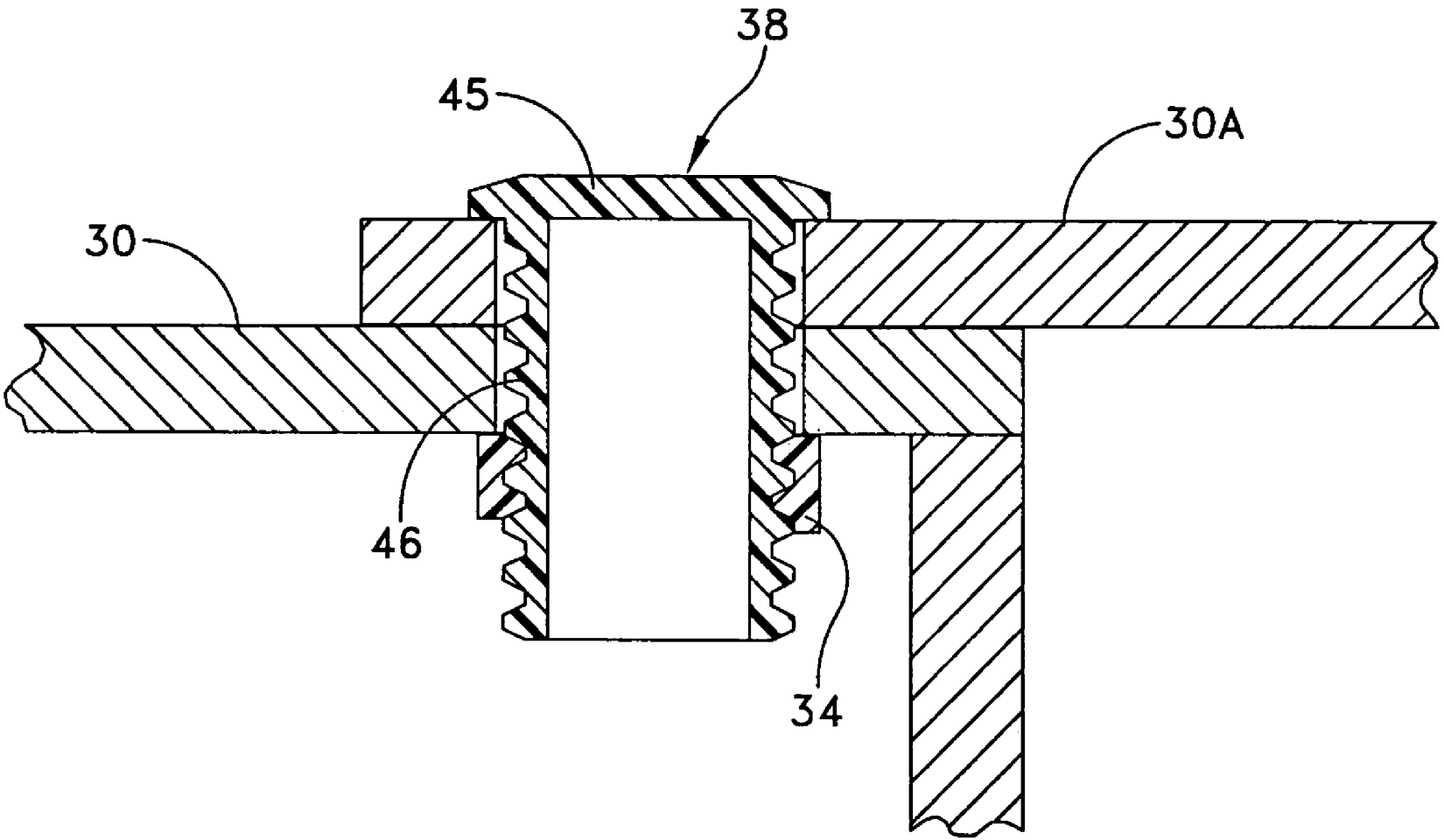
FIG. 11 is a cross-sectional view as taken along line 11-11 of FIG. 7 illustrating the manner in which a ring member and cap screw are interconnected.

Reference to FIG. 8 is helpful in seeing how most of the furniture piece of FIG. 7 is constructed. FIG. 8 is an exploded view that illustrates how all of the various components or pieces are assembled. FIGS. 9-11 are further examples of how the pieces are assembled by taking representative cross-sectional views at various locations of the arrangement shown in FIG. 7. FIG. 9 is a cross-sectional view taken along line 9-9 of FIG. 7 through a location where two leg members 40 are interconnected at a shelf member 30B. A male end 41 of the lower leg member extends up through the hole in the shelf member 30, and the female end 43 of an upper leg member is threaded onto the male end of the lower leg member, as illustrated. The shelf member is retained between these leg members. It is noted that the assembly of these leg members, as well as other components, can be readily carried out without the need for any special tools or fixtures. One has to only hand screw the members together to firmly hold the members in position.

FIG. 10 is a cross-sectional view taken along line 10-10 of FIG. 7 through a location where a leg member 40 and a cap screw are interconnected at a shelf member and the cabinet 10. A female end 43 of the leg member extends up through the hole in the shelf member 30, and the threaded shaft 46 of the cap screw 38 is threaded with the female end of the cap screw, as illustrated. The shelf member and cabinet are retained between these pieces.

FIG. 11 is a cross-sectional view taken along line 11-11 of FIG. 7 through a location where a threaded ring 34 and a' cap screw are interconnected at shelf members. The cap screw 45 is secured by the threaded ring 34 between the two shelf members 30.

Figure 12:
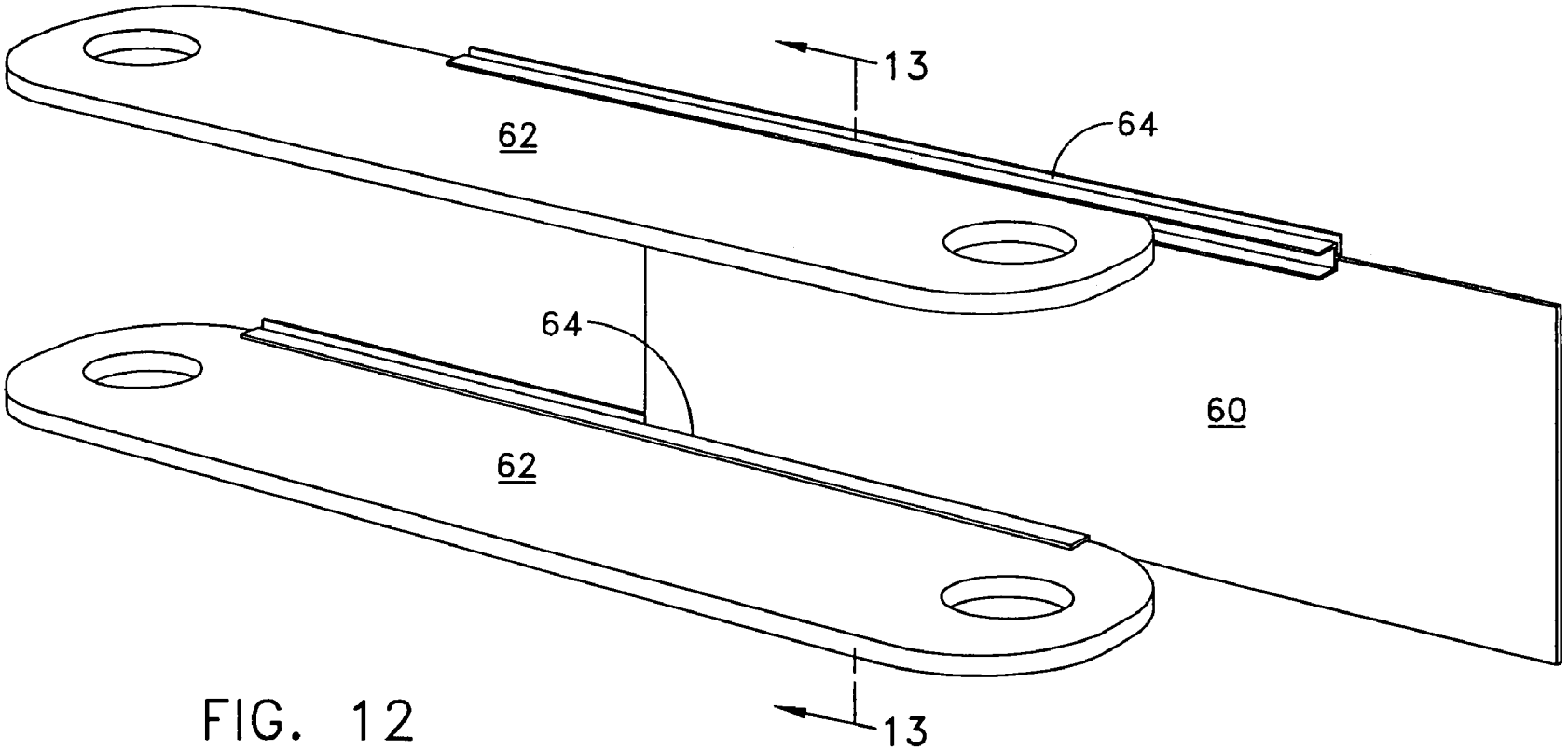
FIG. 12 is a perspective view of an alternate shelf support arrangement used in conjunction with the modular furniture system of the invention.
Figure 13:
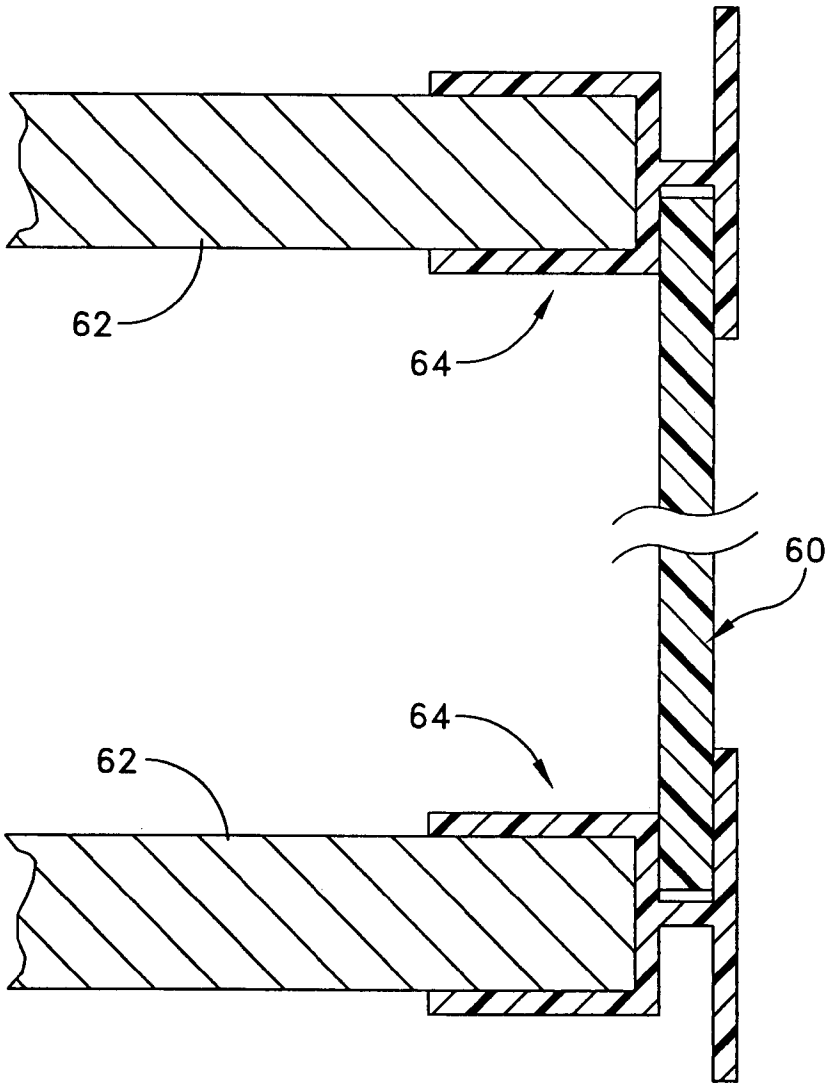
FIG. 13 is a cross-sectional view of the shelf arrangement of FIG. 12 as taken along line 13-13 of FIG. 12.

Refer now to FIG. 12 which is a perspective view of another manner in which shelf members can be supported relative to the modular furniture system. See also the cross-sectional view of FIG. 13 for further details. FIG. 12 shows a backing board 60 that may be attached to a rear surface against which the furniture system rests. This may be between other shelf members on a rear wall. The shelf members 62 are then supported from the backing board 60 by means of bracket 64. Adhesives may be used to secure the backing board to a wall, as well as to secure the brackets 64 to the backing board 60. The shelf members 62 may be slid into the corresponding bracket 64.

Figure 14:
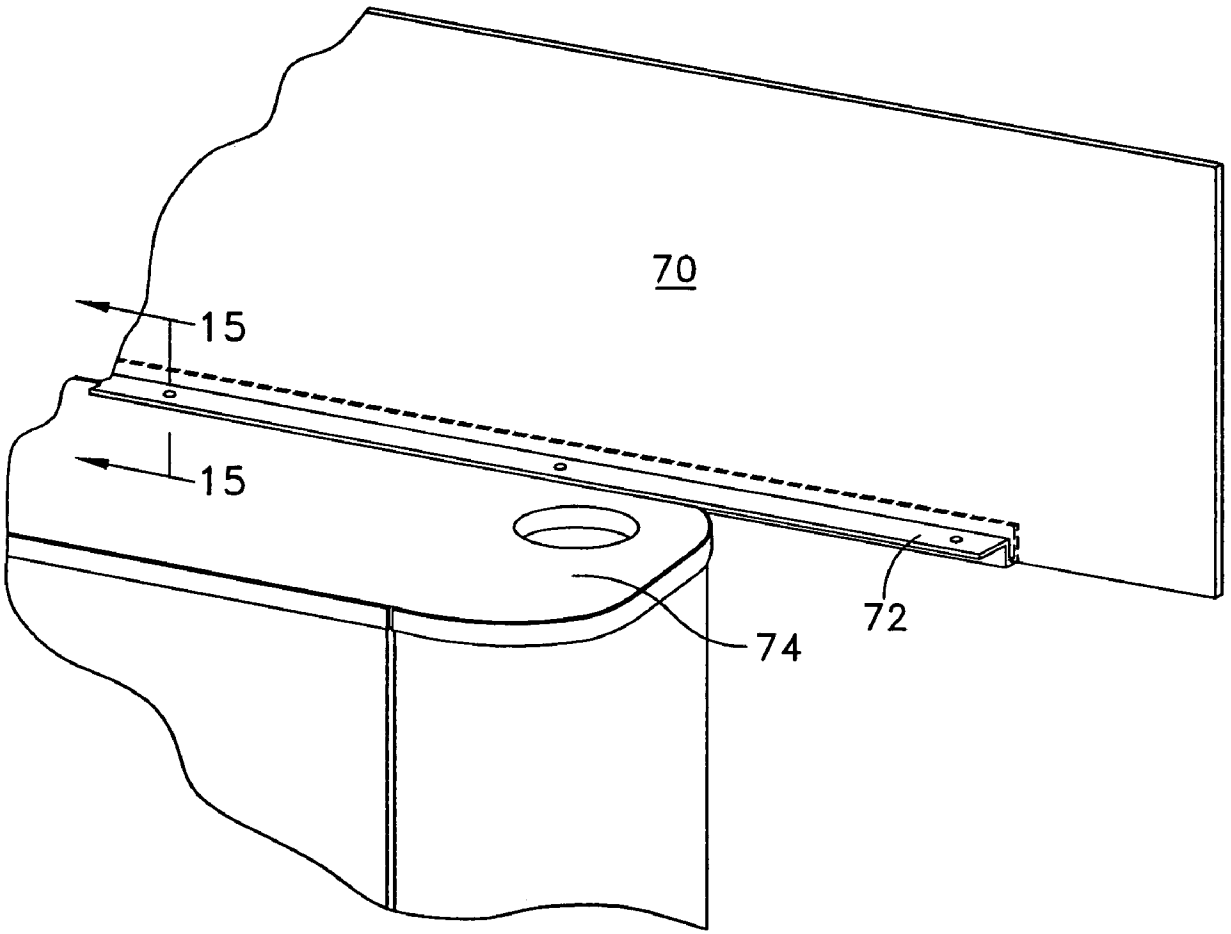
FIG. 14 is a perspective view of still another alternate shelf support arrangement used in conjunction with the modular furniture system of the invention.
Figure 15:
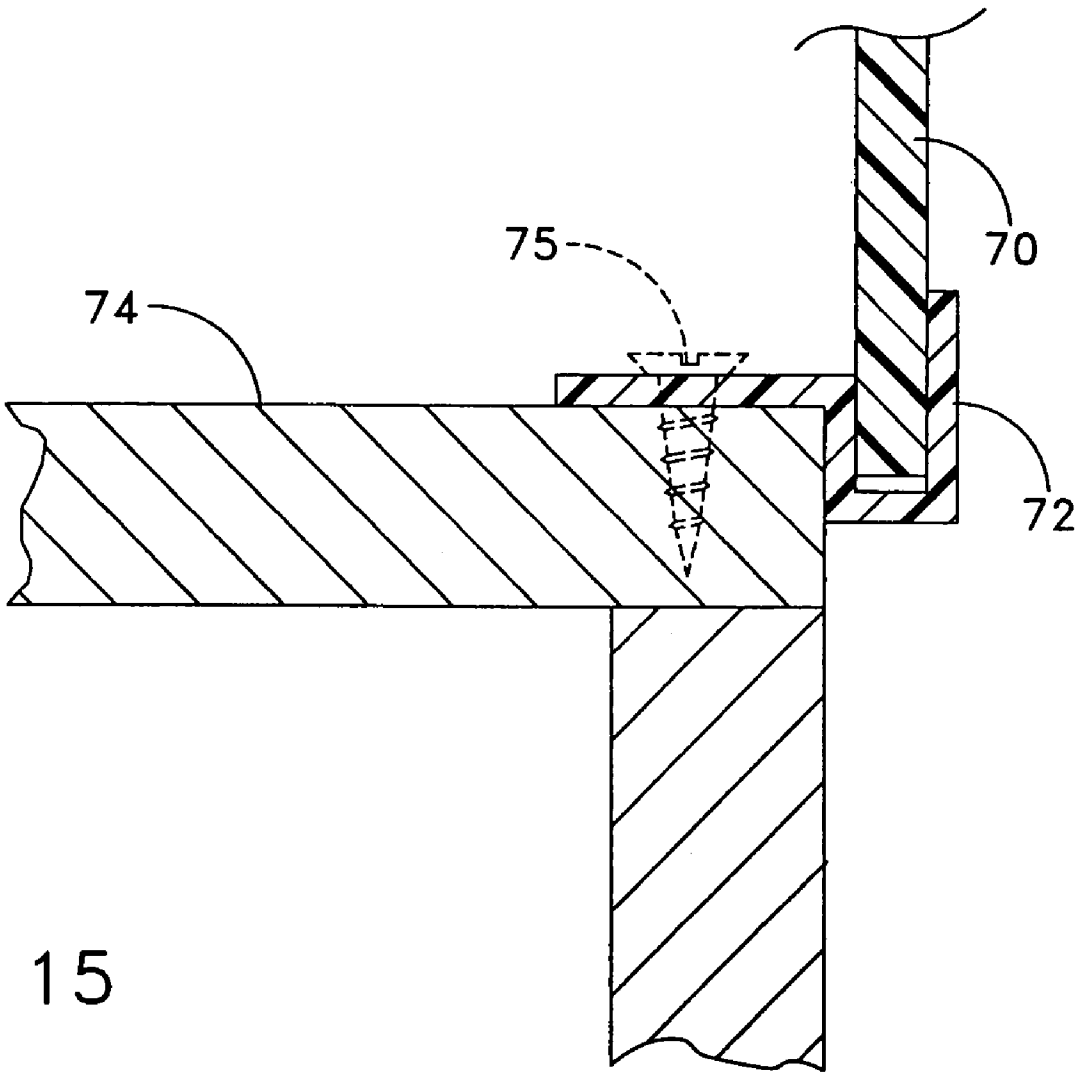
FIG. 15 is a cross-sectional view of the shelf arrangement of FIG. 14 as taken along line 15-15 of FIG. 14.

Refer now also to FIGS. 14 and 15 for illustrations of a further arrangement for supporting a backing board 70. This may be supported above a cabinet top 74 by means of the support bracket 72. A series of screws 75 secures the bracket 72 to the top 74.

Figure 16:
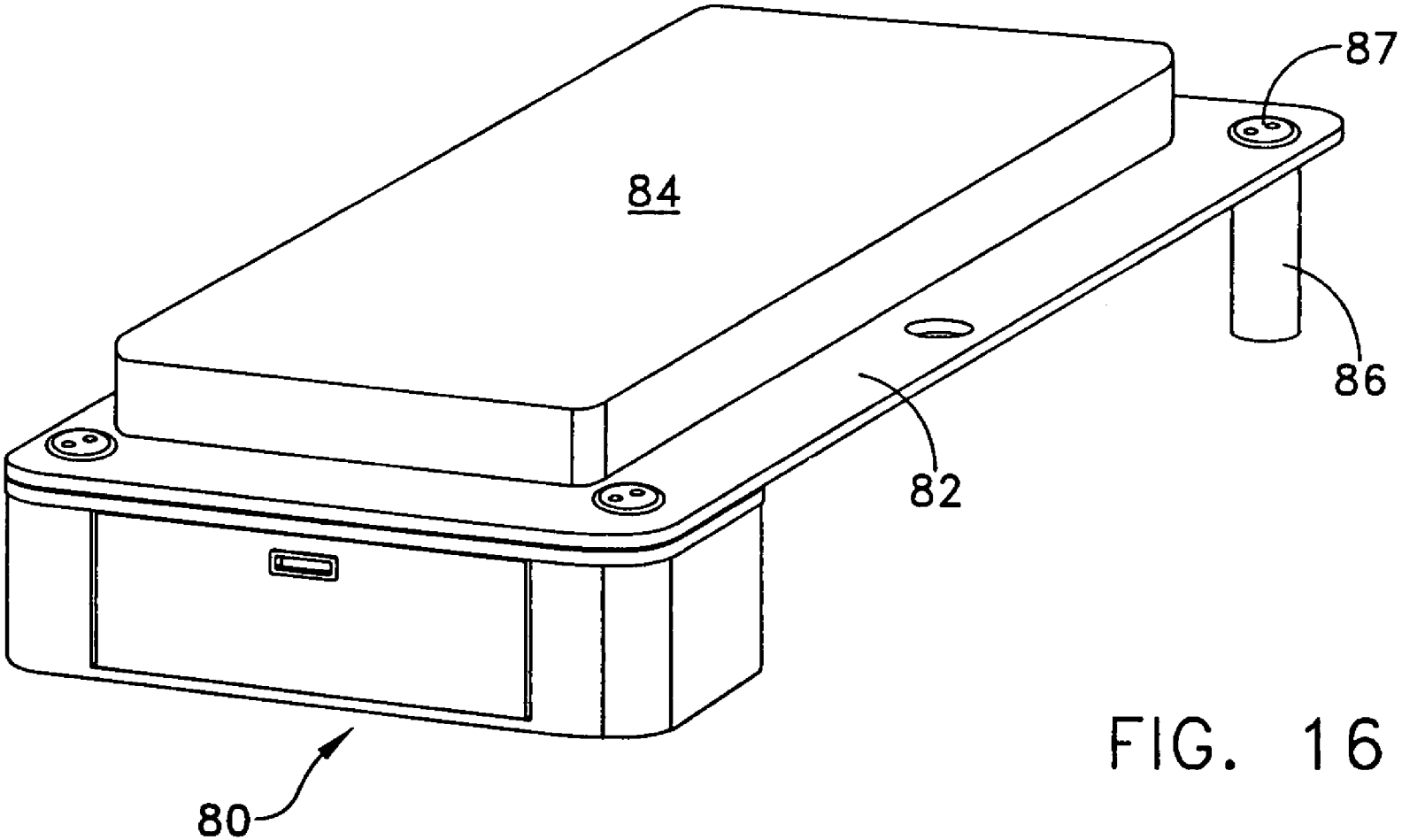
FIG. 16 is a perspective view showing another modular furniture arrangement that can be formed with the system of the present invention.

Refer now to FIG. 16 for an illustration of an alternate furniture arrangement that is easily adapted to the modular furniture system of the present invention. This arrangement includes the base cabinet 80 which may be the same as the base cabinet previously described in FIG. 1 and a bed system made up of a base board 82 supported at one end by the base cabinet 80 and a mattress 84. The other end of the board is supported by the leg members 86 and cap screw 87.

In accordance with the present invention the leg members or posts are preferably hollow, but may also be constructed at least partially solid. The advantage of a hollow post is that it is lighter in weight and thus easier to handle during the fabrication or assembly of the modular furniture system into a configuration such as illustrated in FIG. 7. The leg members, as well as virtually all other components, may be constructed of wood or a wood product such as a laminate formed from wood by-products thus offering the structural integrity of wood yet the lower cost of a by-product material. Alternatively, they can be made from a plastic, glass, plexiglass, fiberglass, chrome, stainless steel, marble, stone, and/or PVC piping. The exterior surface can be finished as desired. For a wood product it can be painted or left natural. For a plastic of other materials it can be painted or provided with another decorative surface pattern.

The shelf members can be made of the same materials as just mentioned for the other components. For example, the shelves can be made of a light weight wood or wood by-product or even a mirrored glass with a decorative surface. Also, the various pieces that are used in the modular furniture system of the invention need not all be made of the same material. For example, the leg members can be plastic while the shelf members are glass or wood.

The components that have been described herein represent only a limited number of variations. The leg members, for example, can be of different lengths and diameters and have different wall thicknesses. They can also have different shape cross-sections such as, but not limited to, round, rectangular, square or multi-sided.

As mentioned previously, one of the significant aspects of the present invention is that the entire assembly or fabrication sequence can be accomplished without the need for any tool or fixtures. It is anticipated that the modular furniture system can be sold in many different arrangements and kit types depending upon the particular piece of furniture that one intends to fabricate. It is further anticipated that the kit is sold with an instruction sheet for the particular piece that is to be made. Also, it is anticipated that each kit is sold with several options for variations of furniture pieces.

Moreover, it is anticipated that the modular furniture system of the present invention could be used to construct not only shelving units, to include room dividers, entertainment centers and etageres; but also to construct tables to include end tables and coffee tables, chairs, benches, floor lamp, plane stands; it may also be used to construct bedroom furniture to include beds, children's beds, bunk beds, trundle beds, as well as tables, chairs and desks used in bedrooms. It is also anticipated that the modular furniture system of this invention be used as well to construct dining room tables and chairs, bars, as well as game room and recreational equipment to include play tables, chairs, benches, shelving and storage cabinets.

It is also anticipated that the modular furniture system of the invention is equally well adapted for use in furnishing offices, to include desks, computer and printer stands, shelving units, and telephone, copier, printer and facsimile stands. This could also include the use of the modular furniture system for creating shelving units, island displays, hanging racks, cash register islands or support tables, and changing rooms in commercial and/or retail establishments.

While preferred embodiments of the invention have now been described, it is understood by those skilled in the art that variations and modifications thereof can be made without departing from the spirit and scope of the present invention.

What is claimed is:

1. A modular furniture system for the storage and support of components that, once assembled, form a piece of modular furniture, said system comprising:

a base cabinet including a front, sides and a top and having a drawer used for storage, said drawer slidably supported in said base cabinet at said front thereof and able to be opened and closed;

said cabinet base top provided with a series of holes;

a plurality of planar shelf members with each planar shelf member having end disposed holes;

a plurality of support members that attach the plurality of planar shelf members in at least one closed stacked array to the top of said base cabinet;

each said support member including a post that attaches the shelf members to the base cabinet top by extending the post through the respective holes in the top of the base cabinet and the shelf member;

the holes in the shelf members being provided in a same pattern as the holes in the top of the base cabinet so that the posts pass through both respective holes in the base cabinet top and shelf members;

said post having an enlarged head at one end and threaded at the other end;

a securing member that is engaged with the post to hold the shelf members in place against the top of the base cabinet;

said securing member comprising a threaded ring for engagement with the threaded end of the post;

wherein each of the shelf members comprises a planar shelf having opposed flat sides, and in which facing flat sides of adjacent shelves are in direct contact for all of the shelves when the post and ring are engaged and in place;

and a plurality of modular leg members that are interengageable by screwing together and that are stored in said drawer; wherein the post attaches the shelf members to the base cabinet by passing the threaded end of the post through the holes in the shelf member and base cabinet top.

2. The modular furniture system of claim 1 wherein the drawer has means at the front thereof that enable a user to open and close the drawer.

3. The modular furniture system of claim 1 wherein the plurality of shelf members include a base shelf member and two sets of narrower shelf members disposed over the base shelf member.

4. The modular furniture system of claim 1 wherein and the head of the post contacts the top of the base cabinet.

5. The modular furniture system of claim 4 wherein the threaded ring comprises an internally threaded ring that is engaged with the threaded end of the post to hold the shelf members to the top of the base cabinet.

6. The modular furniture system of claim 1 wherein the shelf members comprise at least three shelves that are stacked in direct contact one to an adjacent one thereof.

7. The modular furniture system of claim 6 wherein the length of each post is greater than the thickness of three shelves so as to provide a length sufficient to also enable the threaded ring to engage each threaded end of a post to secure the shelves against the top of the base cabinet.

8. A modular furniture system for the storage and support of components that, once assembled, form a piece of modular furniture, said system comprising:

a base cabinet having a front wall, sides, a planar top and a front opening in the front wall;

a drawer having a front surface to which is mounted a handle for opening and closing the drawer;

the drawer used for storage and slidably supported through the front opening in the base cabinet;

a plurality of modular leg members that are interengageable by screwing together and that are stored in said drawer;

the planar top of the base cabinet provided with a series of spacedly disposed holes that are arranged in a first predetermined pattern;

a plurality of planar shelf members, each shelf member having spacedly disposed holes that are arranged in a second predetermined pattern;

the first and second predetermined patterns being the same as to the location of the respective holes;

the plurality of planar shelf members each having opposite side planar surfaces;

a plurality of mounting posts for mounting the plurality of shelf members in at least one closed stacked array to the planar top of the base cabinet;

each said mounting post having, at one end thereof, a head having a diameter greater than the diameter of the shelf member top holes or the base cabinet planar top holes and, at the other end thereof, engagement means;

each said mounting post positioned with the engagement means extending through aligned respective holes in the planar top of the base cabinet and the holes in the plurality of planar shelf members limited in position by the greater diameter of the head of the mounting post;

and a securing member that is engaged with and secured to the engagement means of the mounting post, said securing member holding all of the plurality of planar shelf members in the closed stacked array against the planar top surface of the base cabinet with the facing planar surfaces of the shelf members being in contact one to the adjacent one thereof and held in place against the planar tops surface of the base cabinet by the engagement of the securing member with the mounting post;

wherein the engagement means on the mounting post is formed as a threaded end of the mounting post;

wherein the securing member comprises a securing ring that is internally threaded to mate with the threaded end of the mounting post;

wherein the threading of the ring on the post holds the shelves in place in the closed stacked array.

9. The modular furniture system of claim 8 wherein the plurality of shelf members includes shelf members of different widths.

10. The modular furniture system of claim 8 wherein the shelf members comprise at least three shelves that are stacked in direct contact one to an adjacent one thereof.

11. The modular furniture system of claim 10 wherein the length of each post is greater than the thickness of three shelves so as to provide a length sufficient to also enable the threaded ring to engage each threaded end of a post to secure the shelves against the top of the base cabinet.

12. The modular furniture system of claim 11 wherein the threaded end of the mounting post extends upwardly through the holes of the planar shelf and base cabinet planar top, and the threaded ring is disposed over the plurality of shelf members.

13. The modular furniture system of claim 8 wherein the mounting posts are also useable separate from the stacked array for supporting shelf members spaced one to the adjacent one thereof in assembling the piece of modular furniture.

14. The modular furniture system of claim 13 wherein said plurality of modular leg members are also useable, once removed from said drawer, in assembling the piece of modular furniture.

* * * * *